US008590096B2

(12) United States Patent
Ravinett et al.

(10) Patent No.: US 8,590,096 B2
(45) Date of Patent: Nov. 26, 2013

(54) APPLICATOR AND BUCKET FOR CLEANING PADS

(75) Inventors: Ted Ravinett, Malibu, CA (US); Craig Hidalgo, Langhorne, PA (US); Tom Powers, Newtown, PA (US); Ralph Dowdell, Trenton, NJ (US)

(73) Assignee: EZ1 Step, Inc., Westlake Village, CA (US)

( * ) Notice: Subject to any disclaimer, the term of this patent is extended or adjusted under 35 U.S.C. 154(b) by 13 days.

(21) Appl. No.: 13/212,145

(22) Filed: Aug. 17, 2011

(65) Prior Publication Data

US 2013/0042425 A1 Feb. 21, 2013

(51) Int. Cl.

| | |
|---|---|
| ***A46B 5/02*** | (2006.01) |
| ***A47L 13/10*** | (2006.01) |
| ***B08B 1/00*** | (2006.01) |

(52) U.S. Cl.
USPC ..... 15/209.1; 15/104.94; 15/143.1; 15/228

(58) Field of Classification Search
USPC ..... 15/209.1, 228
See application file for complete search history.

(56) References Cited

U.S. PATENT DOCUMENTS

| | | | | |
|---|---|---|---|---|
| 4,031,673 | A * | 6/1977 | Hagelberg | 451/517 |
| 7,159,265 | B2 * | 1/2007 | Soller et al. | 15/104.94 |
| 2008/0115302 | A1 * | 5/2008 | Kilkenny et al. | 15/104.94 |

* cited by examiner

*Primary Examiner* — Monica Carter
*Assistant Examiner* — Stephanie N Berry
(74) *Attorney, Agent, or Firm* — The Law Offices of Roger S. Thompson

(57) ABSTRACT

An applicator for use in cleaning surfaces, comprising: a bottom surface; a handle disposed above the bottom surface; means for releasably attaching a pad to the bottom surface; and an actuator, accessible from the handle, for actuating the means for releasably attaching the pad to the bottom surface. The means for releasably attaching preferably has a plurality of feet which move between a first position within the applicator to a second position outside the applicator. When the feet are in the second position they can contact a cleaning pad. The feet include means (such as a hook-and-loop fastener) for gripping the cleaning pad, so that when the feet are in the second position, which is the at-rest position, they grip the cleaning pad. When the feet are moved to the first position, they release the pad, allowing for the disposal thereof without having to touch the soiled pad.

13 Claims, 7 Drawing Sheets

APPLICATOR AND BUCKET FOR CLEANING PADS

FIELD OF THE INVENTION

The invention is directed to the field of cleaning apparatus and, more particularly, to the field of household cleaning apparatus for cleaning household surfaces, such as floors, countertops and the like.

BACKGROUND OF THE INVENTION

Cleaning one's house is generally considered a bothersome chore and requires a great deal of intensive manual labor. An unpleasant aspect of that chore is coming in physical contact with the germs, dirt, and cleaning agents used in the process which entails handling and disposing of soiled paper towels, sponges, cleaning cloths or fabric cleaning materials.

Many who would prefer to maintain their homes in good order are put off by the realities of the chore, including cleaning the cleaning equipment, as well as handling and disposing of soiled cleaning products.

There have many approaches to dealing with the problem, and many have centered on using disposable cleaning apparatus, such as "toilet wands" sold under the Clorox brand name. The proliferation of such individually tailored products, however, has led to a further complication.

There are many specialized types of products needed to clean a house thoroughly. For example, a product useful for cleaning wood surfaces, such as wooden tabletops and parquet floors may not be suitable for cleaning glass windows or granite countertops. Glass cleaning products are not suitable for cleaning tile floors. The toilet wands mentioned previously are useful for the task for which they are intended, but are not useful in cleaning appliances or windows, and so on. Many of the specialized products are part of specialized, and incompatible, proprietary systems, so that they require the use of individualized apparatus for use, meaning that each system may have it own handle, its own container for holding suitable cleaning products, etc. This means that one interested in maintaining a household in good order has to maintain a supply of different and incompatible cleaning products and equipment, which can lead to unwanted clutter and difficulty is storing the many different products.

There is therefore a need in the art for apparatus which will provide for the sanitary handling of soiled cleaning products, as well as providing a system for cleaning different surfaces while allowing for the efficient and economical storage of different types of cleaning products suitable for cleaning the variety of household surfaces present in any home.

OBJECTS AND SUMMARY OF THE INVENTION

It is therefore an object of the invention to provide a system for housing and storing cleaning equipment, as well as for using that cleaning equipment, that represents an improvement over known cleaning equipment.

It is a further object of the invention to provide a system and apparatus for cleaning that includes a universal applicator that can be used with a plurality of different types of cleaning products.

It is a still further object of the invention to provide a cleaning system and apparatus in which a user may pick up a new cleaning product, use the cleaning product and dispose of the soiled cleaning product after use, all without the need to physically touch the chemical cleaning product or dirty used product either before or after usage.

It is yet another object of the invention to provide a cleaning system and apparatus in which a handle may be stored together with a housing for holding a cleaning product, for compactness and efficiency.

It is still another object of the invention to provide a cleaning system which compactly and efficiently provides for the storage of cleaning products specially tailored for cleaning many different types of surfaces.

In accordance with these and other objects of the invention, there is provided: an applicator for use in cleaning surfaces, the applicator comprising: a bottom surface; a handle disposed above the bottom surface; means for releasably attaching a pad to the bottom surface; and an actuator, accessible from the handle, for actuating the means for releasably attaching the pad to the bottom surface. The means for releasably attaching preferably has a plurality of feet which move between a first position outside the applicator to a second position within the applicator. When the feet are in the first position they can contact a cleaning pad. The feet include means (such as a hook-and-loop fastener) for gripping the cleaning pad, so that when the feet are in the first position, which is the at-rest position, they grip the cleaning pad. When the feet are moved to the second position, they release the pad, allowing for the disposal thereof without having to touch the soiled pad.

In a further preferred embodiment, the pads are stored in a housing which is configured to interact with the feet so that the applicator may be stored attached to the housing, thereby providing a convenient and efficient configuration for transportation and/or storage.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
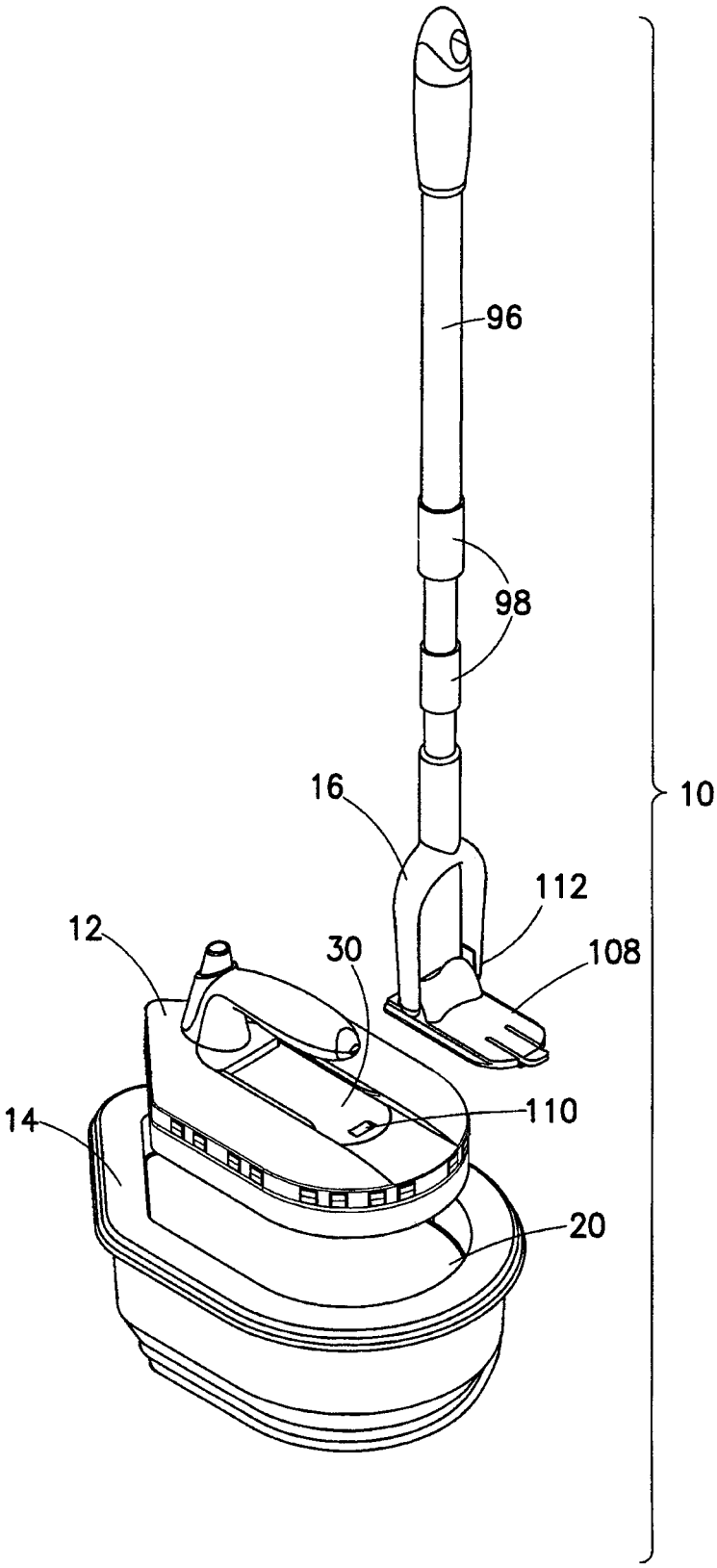
FIG. 1 is an exploded perspective view of the inventive system, in which the various components thereof are shown separated.

A system in accordance with the invention is shown in FIG. 1, generally at 10. System 10 includes an applicator 12, a bucket 14 and a telescoping pole 16. Bucket 14 houses a plurality of pads 18 (FIG. 2) for use in cleaning as will be described presently. Applicator 12 is preferably configured to fit within a top 20 of bucket 14. Applicator 12 may be attached to bucket 14 by any convenient means, such as, for example, by a friction-fit arrangement. However, in a preferred embodiment, described below, a more secure and convenient mechanism for attaching applicator 12 to bucket 14 is provided.

Figure 3:
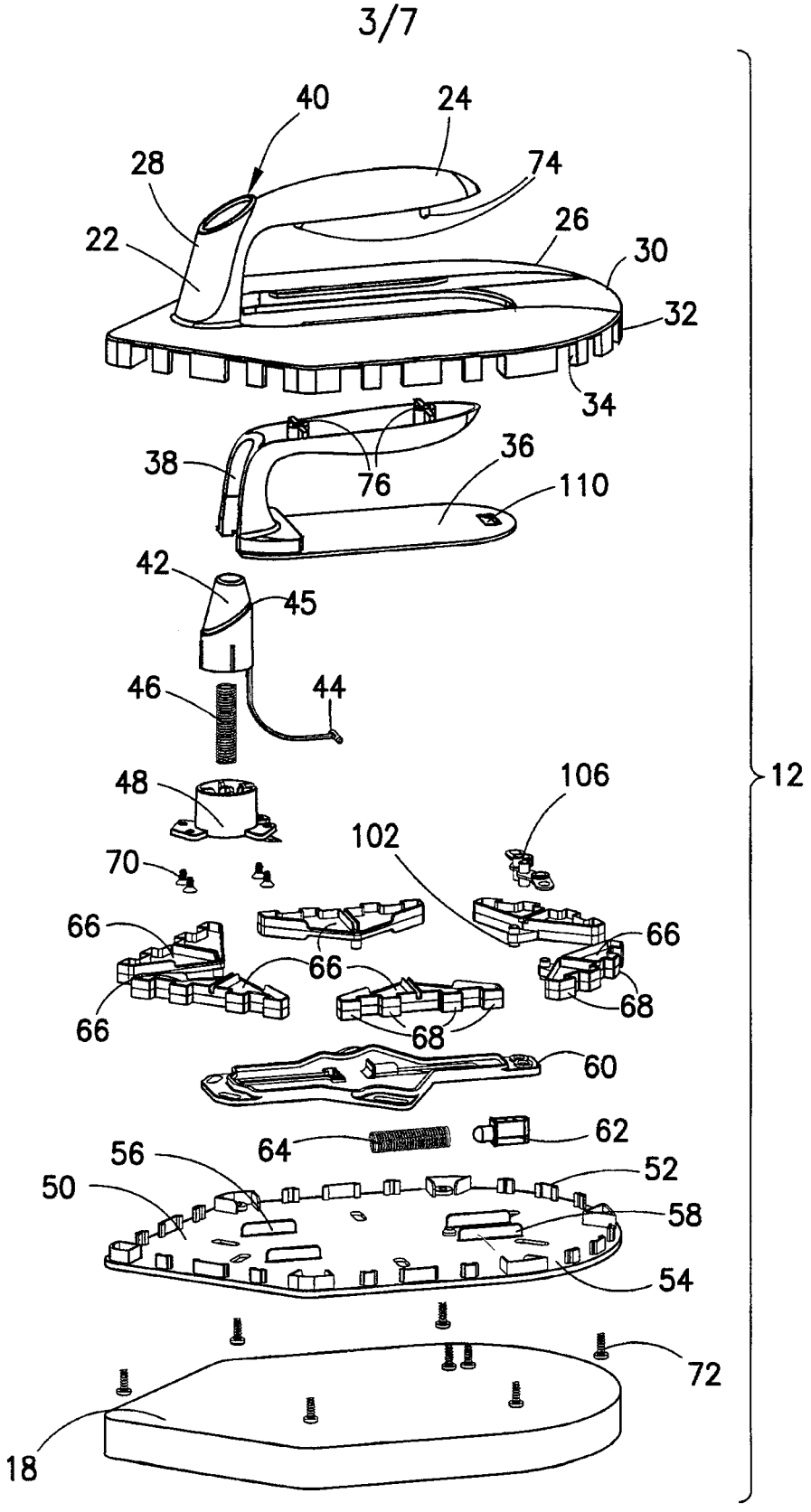
FIG. 3 is an exploded perspective view of a preferred embodiment of the inventive applicator showing its internal components.

Applicator 12 is shown in more detail in FIG. 3. Applicator 12 includes a handle 22 preferably having a gripping portion 24 attached to a lower portion 26 and a front channel portion 28. Handle 22 may also include a slide 30 for attachment thereto of pole 16 (FIG. 1).

Lower portion 26 includes a downwardly depending skirt portion 32 having a plurality of apertures 34 therein.

Applicator 12 further includes a lower handle 36 having a rear channel portion 38 which is configured to mate with front channel portion 28 of handle 22, forming a channel 40 therebetween. A plunger 42 having a tail 44 is positioned within channel 40, and is capable of moving along and within channel 40. The interior of channel 40 is preferably configured to provide a limit on the upward movement of plunger 42 therewithin, as by having a ledge (not shown) therein. Plunger 42 is therefore formed in a fashion which is complementary to channel 40, such as by having a lip 45 thereon, to abut the ledge within channel 40. Other means for limiting the upwards movement of plunger 42 along channel 40, such as by forming plunger 42 in a substantially frusto-conical shape, as shown, and having the inner portion of channel 40 shaped in a complementary fashion. A spring 46 urges plunger upwards while a guide 48 secures plunger 42 within channel 40 at the bottom end of channel 40.

Applicator 12 further includes a cover 50 having a plurality of upwardly facing flanges 52 which define openings 54 (best seen in FIGS. 3 and 5*b*) therebetween. Openings 54 are positioned and configured to align with apertures 34 in skirt 32. Cover 50 includes a guideway 56, 58. A drive plate 60 is positioned to slide within guideway 56, 58. The travel of drive plate 60 along guideway 56, 58 is limited in one direction by a stop 62. Drive plate 60 is also configured to receive tail 44 of plunger 42, so that downward movement of plunger 42 causes tail 44 to move drive plate 60 along guideway 56. 58, thereby translating the vertical movement of plunger 42 along channel 40 to horizontal linear movement of drive plate 60 along guideway 56, 58. A spring 64 urges drive plate 60 away from stop 62 along guideway 56, 58.

Figure 4:
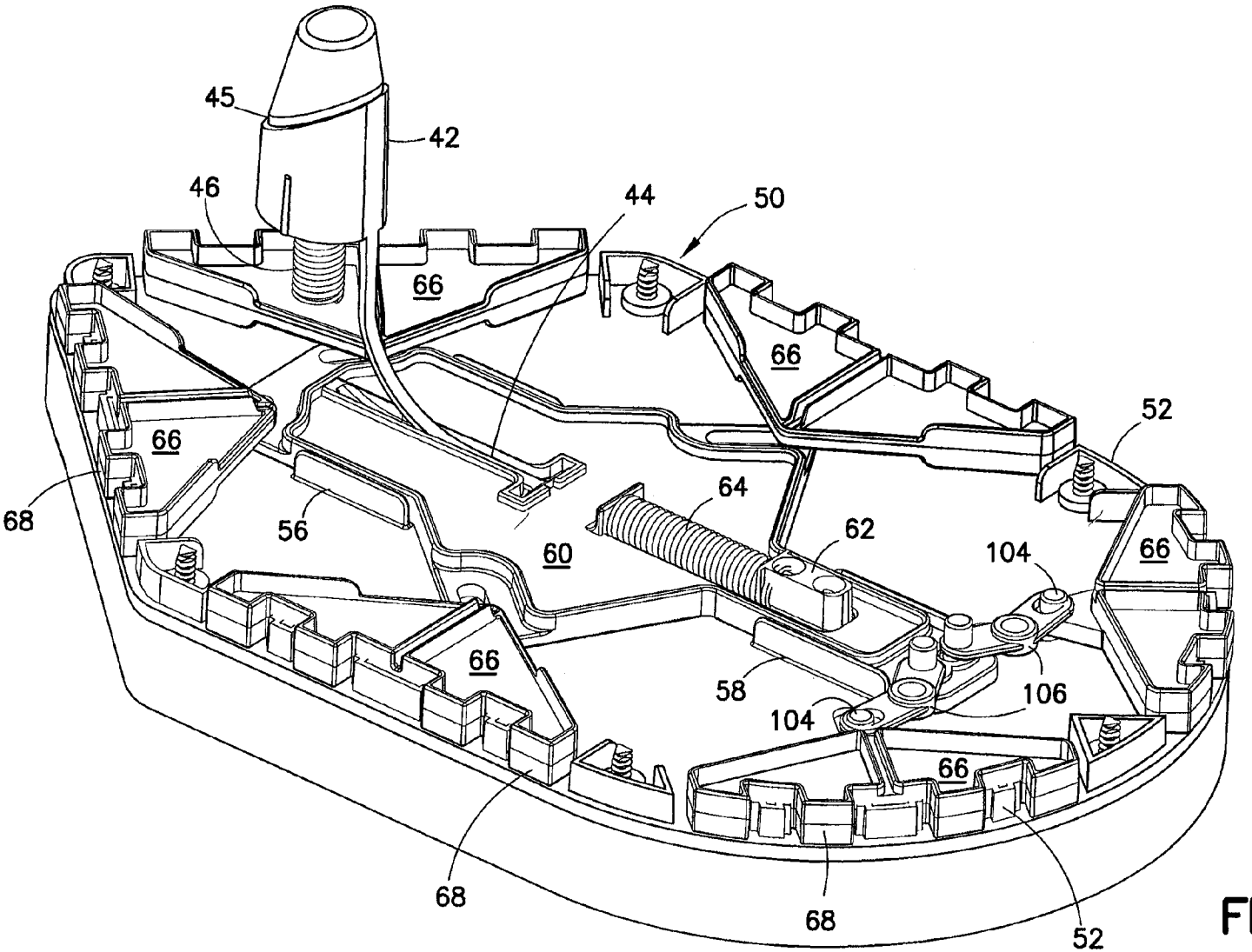
FIG. 4 is a perspective view of selected interior components of a preferred embodiment of the applicator of FIG. 3.
Figure 5A:
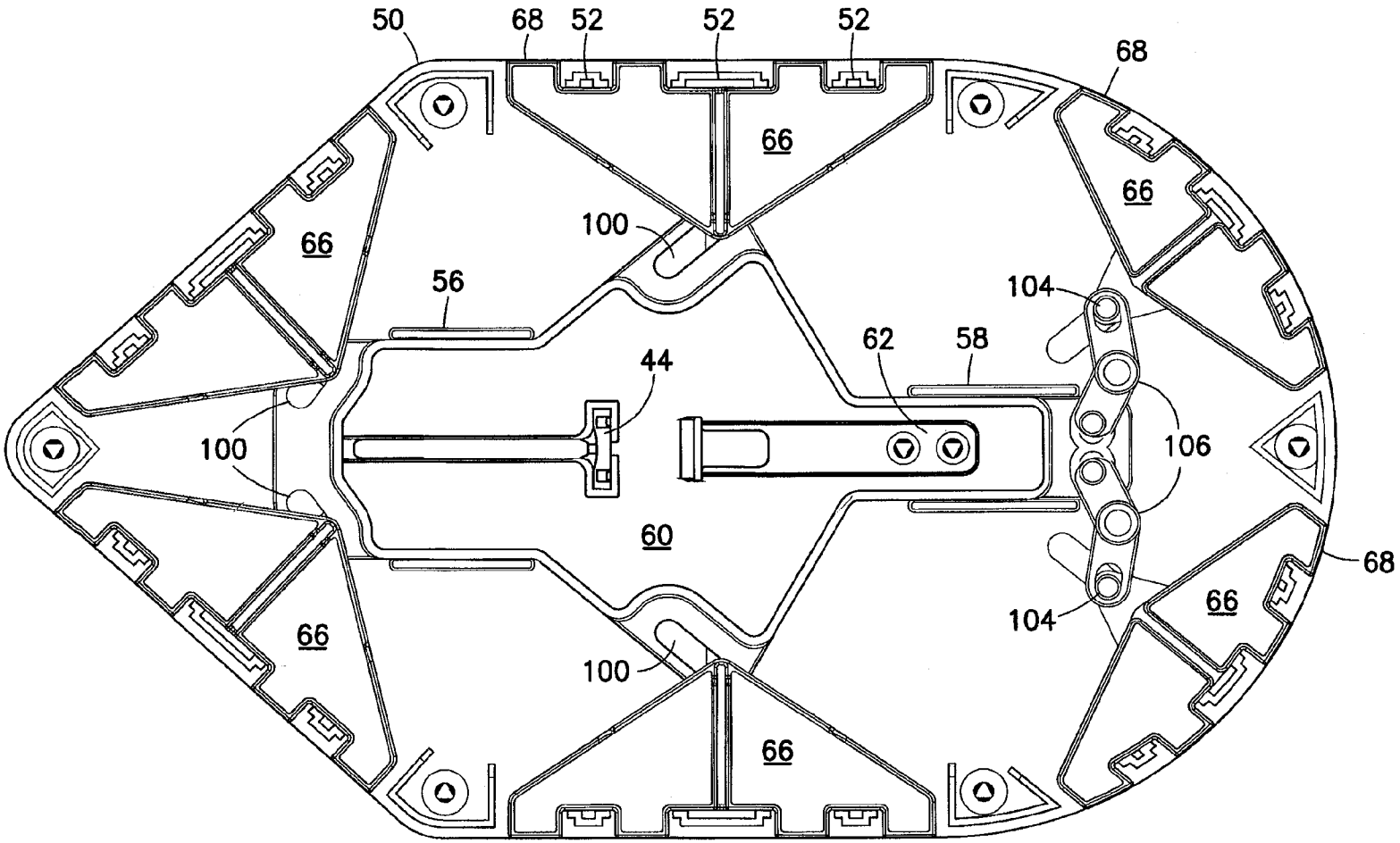
FIGS. 5*a* and 5*b* are top plan view of selected ones of the interior components of the applicator of FIGS. 3 and 4, shown in the working and disengaged positions, respectively.

Applicator 12 also includes a plurality of links 66 having feet 68. Links 66 are configured to move outwardly from applicator 12 when drive plate 60 moves along guideway 56, 58 towards stop 62. Feet 68 are positioned to align with openings 54 and apertures 34, so that feet 68 slide into applicator 12 as plunger 42 is depressed and out of applicator 12 as plunger 42 is released. The movement of links 66 is shown best by a comparison of FIGS. 5*a* and 5*b*. FIG. 5*a* shows applicator 12 at rest, i.e., with no pressure exerted on plunger 42. In this position, drive plate 60 is urged towards the left in FIG. 5*a*, due to the action of spring 64 (FIGS. 3 and 4) on drive plate 60. As seen in FIG. 5*a*, drive plate 60 includes a plurality of slots 100. Certain links 66 include downwardly extending pins 102 (FIG. 3) configured to mate with slots 100. Other links 66 may have upwardly extending pins 104 which are linked to drive plate 60 by complementary linkages 106. The precise mechanism for driving links 66 is a matter of design choice, and any suitable known mechanical linkage may be used, as is well within the knowledge and skill of one of ordinary skill in the art. The important feature of the inventive system is that movement of drive plate 60 by the depression of plunger 42 causes feet 68 to retract within applicator 12 (illustrated in FIG. 5*b*), for reasons which will be described presently.

The various components of applicator 12 may be assembled in any desired and convenient fashion as is well within the ability of one of ordinary skill in the art as a matter of design choice. In the preferred embodiment, however, guide 48 is screwed to cover 50 by screws 70 and cover 50 is secured to handle 22 by screws 72. Lower handle 36 is preferably attached to handle 22 by means of mating snap fit connections 74, 76. The attachment of lower handle 36 to handle 22 may be further effected or assisted by adhesive, or other means for connection such as sonic welding.

Figure 5B:
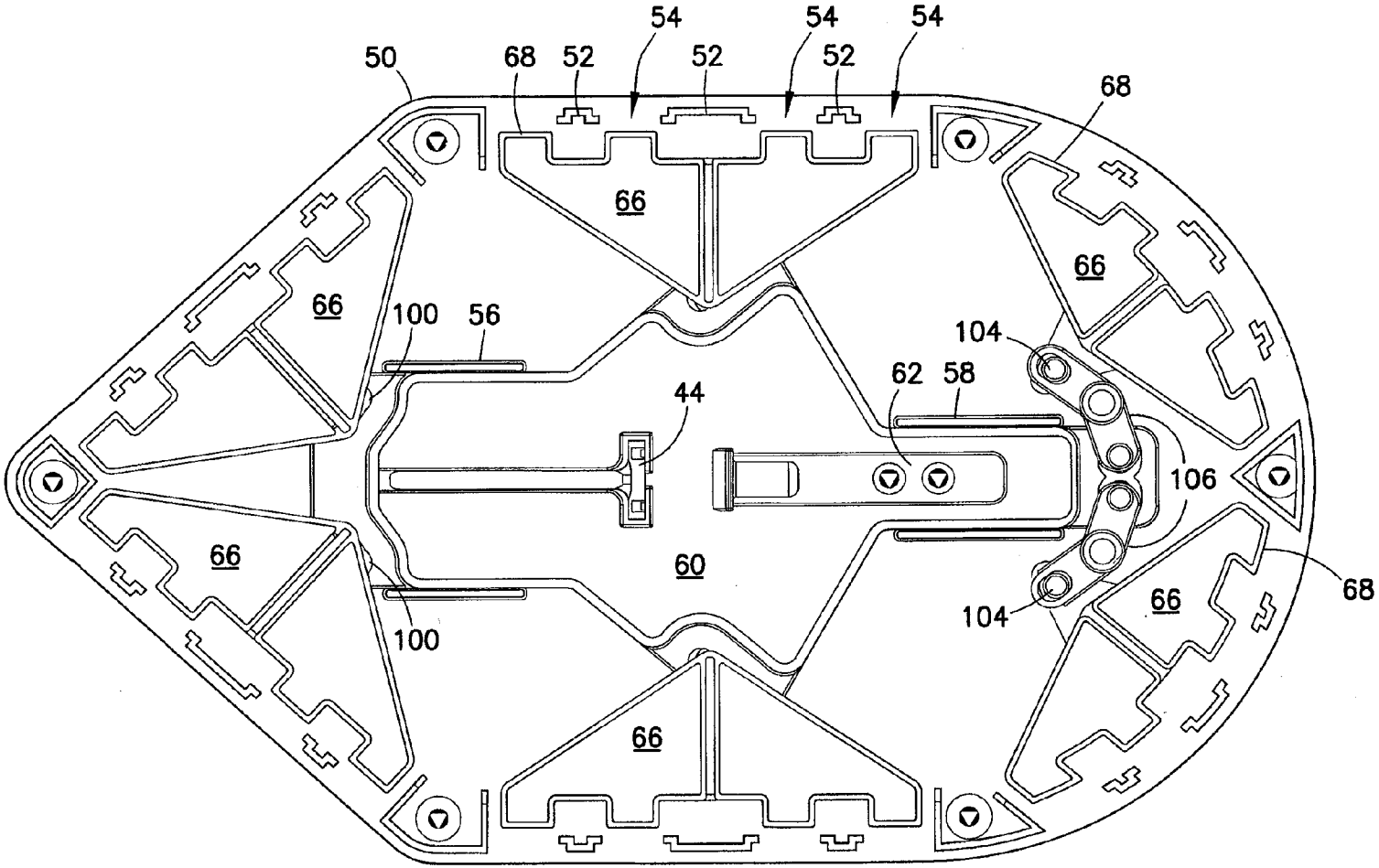

Once assembled, applicator 12 is at rest. Spring 62 urges drive plate 60 along guideway 56, 58 away from stop 62. This force causes drive plate 60 to exert pressure on tail 44 to urge plunger 42 upwards. This force is assisted by the direct upwards action of spring 46. Plunger 42 is therefore urged upwards to the extent of travel along channel 40 permitted by the interaction of the ledge (not shown) within channel 40 and lip 45. The top of plunger 42 will extend to a desired position above or slightly below the top of channel 40 so that it may be easily contacted by a user. In the at-rest position with plunger 42 at its furthest upwards extent, drive plate 60 is at its furthest extent away from stop 62 (FIG. 5*a*), and, in this position, links 66 are extended so that feet 68 are outside of apertures 34 of applicator 12. When plunger 42 is depressed, the downward movement thereof causes tail 44 to move drive plate 60 towards stop 62, causing drive plate 60 to contact links 66 and pull them inwards drawing feet 68 within applicator 12 (FIG. 5*b*).

Figure 2:
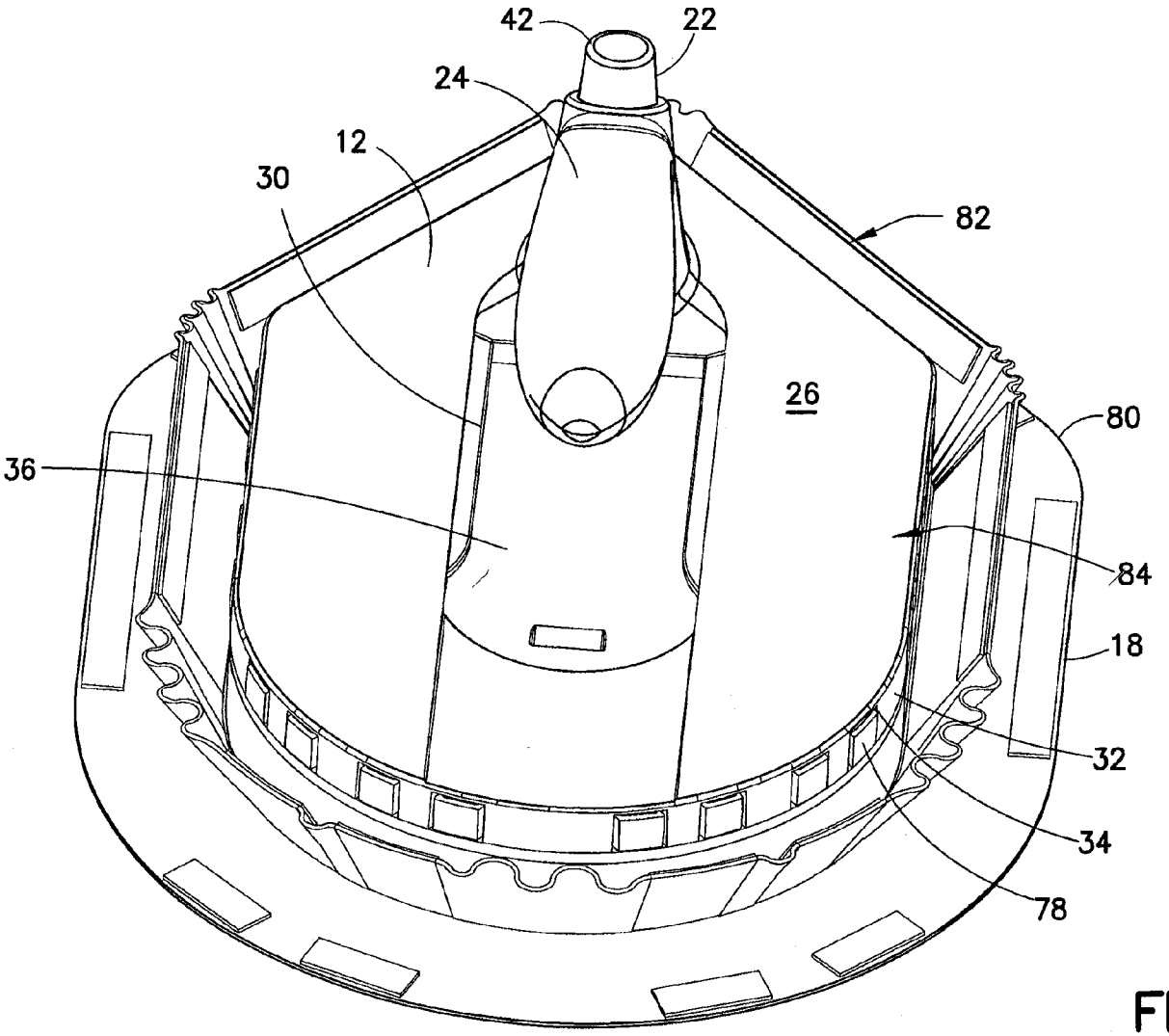
FIG. 2 is a perspective view of a preferred embodiment of the applicator of the invention being placed in contact with a pad used for cleaning in the inventive system.

In use, applicator 12 is used with pad 18 to clean various different kinds of surfaces. For this purpose, there are preferably many different kinds of pads 18, all of which have the same basic configuration, as shown in FIGS. 2 and 3, namely having a contour which follows the exterior of applicator 12. Currently, the preferred configuration of applicator 12 is as shown, which may be generally described as shaped like a conventional steam iron, although the precise configuration is a matter of design choice.

Different types of pad 18 may have different purposes, such as pads for cleaning glass, tile, etc. In any case, it is preferred if the individual pads 18 are impregnated with a cleaning solution, whether liquid, mixture, suspension or solid abrasive as desired. The pads themselves are preferably made of a paper or paper-like material having a "fuzzy" surface. This is so the material of which the pads are made may act as the loop portion of a hook-and-loop fastener for ease of attachment to applicator 12. To provide the hook of the hook-and-loop fastener, a hook material 78 is preferably affixed to the ends of feet 68. Each pad includes a bottom portion surrounded by a collar portion 80 so that the exterior dimension, of pad 18 is larger than that of the bottom of cover 50 of applicator 12. Collar portion 80 extends beyond the edges of applicator 12 and includes corrugations 82 which give an unused pad 18 a shape reminiscent of a coffee filter, so that pads 18 may be stacked and nested one within another within bucket 14.

Depending upon the preferred nature of pad 18, it may not be feasible to manufacture the entire pad 18 out of a "fuzzy" material, to act as the loop portion of the hook-and-loop fastener. In such embodiments, each pad may include an additional strip of loop material 82 positioned on collar portion 80.

Applicator 12 may now be used.

In use, a user will place the bottom of cover 50 of applicator 12 on the top of the top-most pad 18 within bucket 14. If a modest amount of downward force is exerted on pad 18, collar portion 80 will naturally tend to move in the direction of arrow 84 (FIG. 2) so that pad 18 (and/or loop material 82) will come into contact with the extended feet 68 bearing hook material 78. The contact of attachment material 78 to pad 18 is automatic, caused by the mere contact of the hook and loop portions of hook-and-loop fastener 78, 82, and the user does not have to touch pad 18 to effect adhesion of pad 18 to applicator 12.

At this point, plunger 42 is in its fully extended position, and feet 68 are located outside of applicator 12. The secure attachment provided by hook-and-loop fastener 78, 82 allows unfettered use of pad 18 for its intended cleaning purpose. Once the user is done with that particular pad 18, the user simply places applicator 12 above any trash receptacle, and depresses plunger 42, retracting feet 68 within applicator 12, allowing hook material 78 and loop material 82 to disengage and pad 18 to fall, untouched, into the trash.

Thus, the user may deploy, use and dispose of pad 18 without ever having to contact pad 18 and expose him- or herself to the (potentially) caustic cleaning material of an unused pad, or to the soiled, used, pad.

Figure 6:
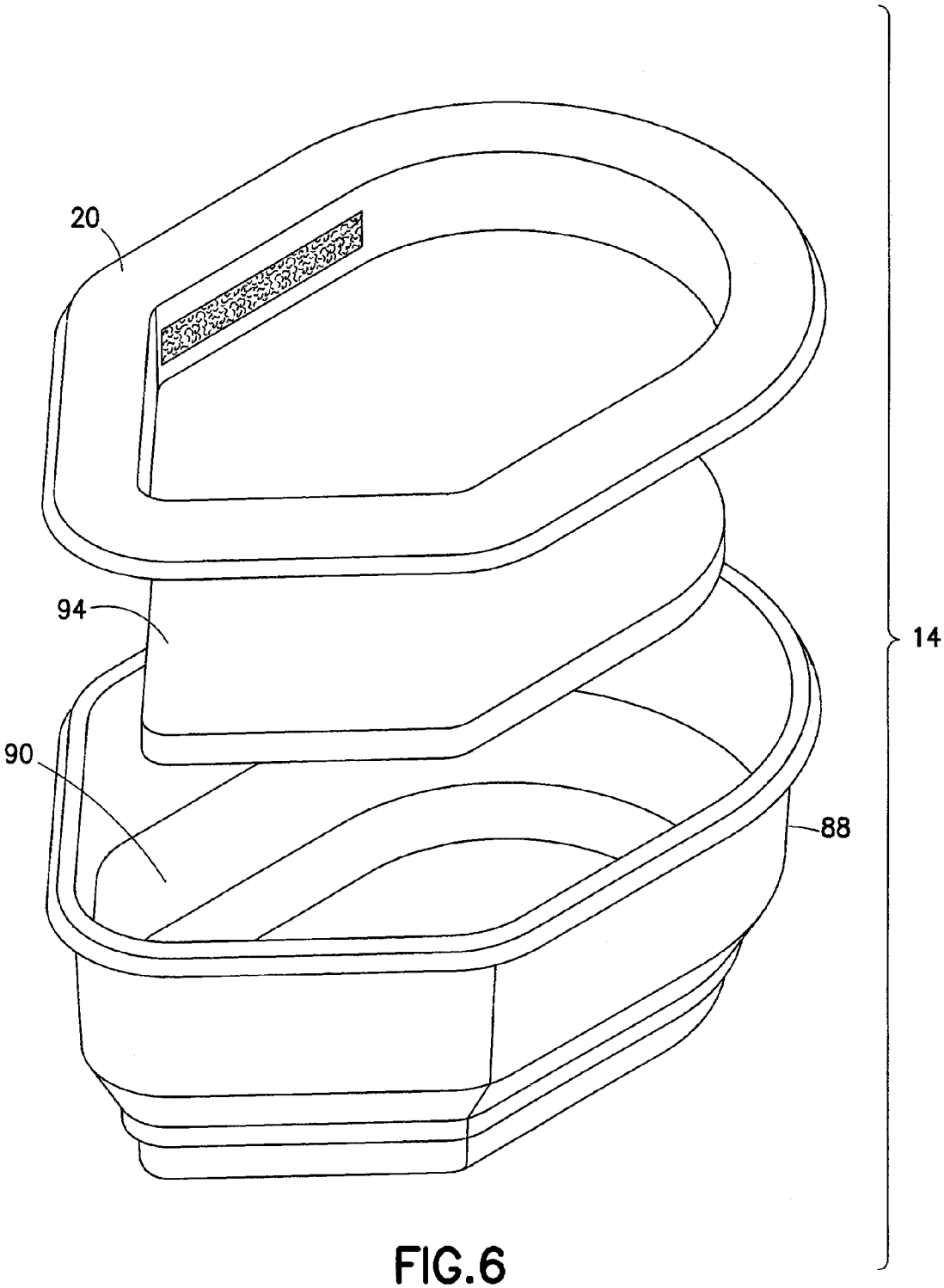
FIG. 6 is an exploded perspective of the bucket used in the inventive system.

The design of bucket 14 is shown in more detail in FIG. 6. Bucket 14 includes a bottom 88 having sloping side walls 90 and top 20 removably attachable thereto. In the preferred embodiment, top 20 is snap fit to bottom 88, although any suitable mechanism may be employed. In one preferred embodiment (illustrated), top 20 includes a series of recesses 92 arranged about the interior thereof. Recesses 92 are configured and positioned to mate with feet 68 of applicator 12 when feet 68 are extended beyond the sides of applicator 12, so that applicator 12 may be stored affixed to top 20 when not in use. It is also preferred that bucket 14 include a sponge 94 (FIG. 6). Sponge 94 serves several purposes. First, for pads which are impregnated with a liquid, sponge 94 serves as a reservoir of additional cleaning liquid to forestall drying out of pads 18. Second, sponge 94 may also serve to absorb any additional cleaning liquid which may drip from pads 18. Finally, sponge 94 provides a soft bottom for the stack of pads 94 so that the stack of pads 18 always have a little "give" when an applicator is pressed down thereon, making it easier to have collar portion 80 move in the required direction. This movement is also assisted by the slope of side wall 90. By constructing the bottom of bucket bottom 88 to match closely the shape of the bottom of cover 50, it is possible to nest multiple buckets one on top of another, for ease of storage.

In some embodiments, it may be desired to increase the reach of applicator 12, for example to make cleaning a floor, wall or ceiling easier. To this end, pole 16 may be provided. Pole 16 is preferably telescoping, in any known fashion, such as by having several lengths of tube 96 connected by conventional locks 98. Pole 16 further includes a foot 108 configured to go into slide 30 of applicator 12 where it may be secured by snapping into a detent 110. Preferably, foot 108 is pivotably attached to tubes 96 at a pivot point 112 for ease of movement.

Applicator 12 and the various components thereof are preferably made of any moldable plastic. The preferred plastic is a polypropylene co-polymer.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An applicator for use in cleaning surfaces, the applicator comprising:

a bottom surface;

a handle disposed above said bottom surface;

means for releasably attaching a pad to said bottom surface, said means for releasably attaching including a plurality of links, actuated by said actuator, to move between a first position partially outside of said housing in which said links may engage one of the pads, and a second position substantially completely within said housing in which said links may release the one of the pads; and an actuator, accessible from said handle, for actuating said means for releasably attaching the pad to said bottom surface;

wherein each of said links includes a foot bearing means for releasably fixing said foot to the one of the pads, and wherein each said foot is disposed at least partially outside of said housing when said links are in said first position and is disposed substantially completely within said housing when said links are in said second position.

2. The applicator of claim 1, wherein said means for releasably fixing includes one part of a hook and loop fastener.

3. The applicator of claim 2, wherein said one part is the hook of a hook and loop fastener.

4. The applicator of claim 1, further comprising means for releasably attaching the applicator to an extension apparatus.

5. An assembly for cleaning surfaces, the assembly comprising:

a container for holding at least one pad;

an applicator including a bottom surface;

a handle disposed above said bottom surface;

means for releasably attaching one of the at least one pads to said bottom surface, said means for releasably attaching including a plurality of links, actuated by said actuator, to move between a first position partially outside of said housing in which said links may engage one of the pads, and a second position substantially completely within said housing in which said links may release the one of the pads;

an actuator, accessible from said handle, for actuating said means for releasably attaching one of the at least one pads to said bottom surface; and means for releasably attaching said applicator to said container;

wherein each of said links includes a foot bearing means for releasably fixing said foot to the one of the pads, and wherein each said foot is disposed at least partially outside of said housing when said links are in said first position and is disposed substantially completely within said housing when said links are in said second position.

6. The assembly of claim 5, wherein said means for releasably attaching one of the at least one pads to said bottom surface and said means for releasably attaching said applicator to said container are a single means for releasably attaching.

7. The assembly of claim 5, wherein said means for releasably attaching said foot to the one of the pads includes one part of a hook and loop fastener.

8. The assembly of claim 7, wherein said one part is the hook of a hook and loop fastener.

9. The assembly of claim 5, further comprising means for attaching the applicator to an extension apparatus.

10. An assembly for cleaning surfaces, the assembly comprising:

a first container for holding at least one pad having means for releasably affixing said first container to a second container;

an applicator including a bottom surface;

a handle disposed above said bottom surface;

means for releasably attaching one of the at least one pads to said bottom surface;

an actuator, accessible from said handle, for actuating said means for releasably attaching one of the at least one pads to said bottom surface; and means for releasably attaching said applicator to said container.

11. The assembly of claim 10, wherein said means for releasably affixing said first container to a second container is a snap-fit connection, whereby a bottom of said first container is configured to snap into a top of said second container, thereby forming a stack of containers.

12. The assembly of claim 10, wherein said first container contains a first type of pad and said second container contains a second type of pad.

13. Apparatus for cleaning surfaces, comprising:

a container for holding at least one cleaning pad, said container having a plurality of recesses disposed about a top thereof;

an applicator including a housing having a bottom surface;

a handle disposed above said bottom surface at a top of said housing; and a plurality of links for releasably attaching one of the at least one cleaning pads to said bottom surface; and an actuator, accessible from said handle, for actuating said plurality of links to move between a first position partially outside of said housing in which said links may engage one of the cleaning pads, and a second position substantially completely within said housing in which said links may release the one of the cleaning pads;

wherein said first position is also situated so that at least some of said plurality of links may engage said slots in said container when said links are in said first position.

* * * * *